United States Patent [19]

Cowan

[11] 4,181,331

[45] * Jan. 1, 1980

[54] HANGER APPARATUS FOR SUSPENDING PIPES

[75] Inventor: William S. Cowan, West University Place, Tex.

[73] Assignee: Armco Inc., Middletown, Ohio

[ * ] Notice: The portion of the term of this patent subsequent to Sep. 18, 1996, has been disclaimed.

[21] Appl. No.: 915,902

[22] Filed: Jun. 16, 1978

[51] Int. Cl.[2] ..... F16L 39/00

[52] U.S. Cl. ..... 285/141; 285/307; 166/208; 166/217

[58] Field of Search ..... 285/140–143, 285/321, 307, 744–746, 87; 166/208, 315, 217, 115, 214

[56] References Cited

U.S. PATENT DOCUMENTS

| | | | |
|---|---|---|---|
| 3,134,610 | 5/1964 | Musolf | 285/147 X |
| 3,216,503 | 11/1965 | Fisher et al. | 166/208 X |
| 3,227,218 | 1/1966 | Fisher et al. | 166/208 X |
| 3,378,077 | 4/1968 | Elliston | 166/115 X |
| 3,420,308 | 1/1969 | Putch | 285/140 |
| 3,472,530 | 10/1969 | Fowler | 285/141 X |
| 3,736,984 | 6/1973 | Garrett | 166/208 |
| 3,741,589 | 6/1973 | Herd et al. | 285/141 X |
| 3,800,869 | 4/1974 | Herd et al. | 166/315 X |
| 3,918,747 | 11/1975 | Putch | 285/141 X |
| 3,946,807 | 3/1976 | Amoncharla | 166/208 X |
| 3,971,576 | 7/1976 | Herd et al. | 285/87 |
| 3,974,875 | 8/1976 | Herd et al. | 285/87 X |

FOREIGN PATENT DOCUMENTS

| | | | |
|---|---|---|---|
| 1159967 | 2/1958 | France | 285/148 |

*Primary Examiner*—Dave W. Arola

*Attorney, Agent, or Firm*—Roylance, Abrams, Berdo & Farley

[57] ABSTRACT

In hanger apparatus of the type comprising a hanger mandrel carried by an inner pipe, an outer body which can be carried by an outer pipe, and a resiliently contractable annular locking device carried by the mandrel for locking the mandrel to the hanger body to suspend the inner pipe, the locking device comprises two independent annular resilient means, the upper one of which constitutes a locking means to cooperate with a locking groove in the hanger body and the lower one of which constitutes a catching means to cooperate with a catching groove in the hanger body below the locking groove. The two annular means are disposed in an outwardly opening annular recess presented by the mandrel. The invention has the advantage that the locking means, which may be a split ring, can be wholly within the mandrel recess as the mandrel is run down to the hanger body, the active outer surfaces of the locking ring thus being protected from being damaged during the trip down to the hanger body. A further advantage is that the catching device, being independent from the locking device, can be more resilient.

7 Claims, 4 Drawing Figures

HANGER APPARATUS FOR SUSPENDING PIPES

CROSS REFERENCES TO RELATED APPLICATIONS

The subject matter of this invention is related to my copending applications Ser. No. 915,829 and Ser. No. 915,830, filed concurrently herewith.

BACKGROUND OF THE INVENTION

It has long been a common practice in the well art to suspend an inner pipe, typically a casing string, concentrically within an outer member, typically an outer casing string or a wellhead member, by means of a hanger comprising a hanger member connected to the inner pipe and having a downwardly directed shoulder which engages an upwardly directed shoulder on the outer member as the inner pipe is run in. As the art developed, it became necessary to minimize the annular space between the inner and outer hanger members, and prior art workers have developed hangers employing a retractable hanger device carried by a mandrel on the inner pipe and capable of expanding into engagement with an outer hanger member when, as the inner pipe is run in, the mandrel reaches the outer hanger member. Pipe hangers of this type have become particularly important with the advent of offshore practices in which the hanger is located at the mudline and the outer pipe above the wellhead is of the same diameter as the outer casing below the wellhead and the annular space available for the hanger is relatively small. Such hangers sometimes employ an annular retractable hanger means in the form of a circular series of mutually independent segments with each segment being spring-biased outwardly as shown, for example, in U.S. Pat. No. 3,472,530 Fowler. In other prior-art devices of this type, the retractable hanger device is in the form of a split ring as seen, for example, in the following U.S. Pat. Nos.:

3,420,308—Putch
3,741,589—Herd et al.
3,800,869—Herd et al.
3,971,576—Herd et al.
3,974,875—Herd et al.

Though hangers of this general type have achieved considerable success, they still present problems which increase in severity as the annular space available at the hanger decreases and the weight of the pipe string to be suspended increases. It has proved difficult to design either an assembly of segments or on integral split ring which is dimensioned to be accommodated in the small annular space available, adequately strong to carry the heavy loads applied by the suspending pipe and, while adequately resiliently compressible to successfully enter the outer body from which the pipe is to be suspended, is yet effective to come automatically into full positive engagement with the outer body as landing of the string is completed. Further, hangers of this type require that the retractable hanger device, whether it be made up of a plurality of segments or be in the form of a split ring, be initially secured in releasable fashion to the mandrel in such fashion that, once releasable fashion that, once the retractable hanger device has engaged the outer body, further downward movement of the mandrel is possible to complete the operation. In some cases, the segments or the ring have been releasably secured to the mandrel by shear members, but this has the disadvantage that care must be taken to avoid portions of the shear member dropping into the annulus to become damaging debris, and it is therefore advantageous to employ other forms of releasable securing means. Such devices are practical with resilient retaining means such as disclosed in my copending application Ser. No. 915,830, for example. With releasable securing means of this general type, however, it is desirable to have at least a lower portion of the annular locking device be especially resilient and more easily distortable than is that portion of the device which actually supports the load of the suspended pipe. There has thus been a continuing need for improvement of devices of this general type.

OBJECTS OF THE INVENTION

One object of the invention is to provide hanger apparatus of the type described in which the annular resiliently contractable locking device carried by the mandrel includes two mutually independent annular means, one constituting the locking means and the other constituting the catching means.

Another object is to devise such a hanger apparatus wherein, as the combination of the mandrel and the resilient annular locking device is run down to the hanger body, that element carrying the active locking surfaces will be wholly within an annular recess in the mandrel.

A further object is to provide such an apparatus wherein that portion of the annular locking device which includes releasable means for securing the device to the mandrel can be made especially resilient.

SUMMARY OF THE INVENTION

Broadly considered, hanger apparatus according to the invention comprises an outer tubular hanger body, which can be carried by an outer string of casing, and which includes at its upper end an upwardly directed transverse annular camming shoulder and, below that shoulder, two axially spaced transverse annular inwardly opening grooves, the upper one of the grooves constituting a locking groove and the lower one of the grooves constituting a catching groove. The apparatus also includes a tubular hanger mandrel and a resiliently retractable annular locking device carried by the mandrel. The mandrel presents an elongated transverse annular recess and the locking device is disposed in the recess. At the lower end of the recess there is a transverse annular upwardly directed stop shoulder. At the upper end of the recess, the mandrel carries a downwardly directed transverse annular load-bearing shoulder. Spaced below the load-bearing shoulder, the mandrel has an annular surface of substantially smaller diameter than is the load-bearing shoulder, and the mandrel presents a downwardly and inwardly tapering actuating surface between the load-bearing shoulder and the smaller diameter surface. The annular locking device comprises a locking means, advantageously in the form of an axially short split ring, and a catching means, advantageously in the form of a split ring which, being separate from the locking ring, can be significantly more resilient than would be the combination of the two rings in an integral structure. The locking means presents a transverse annular outwardly projecting locking rib adapted to cooperate with the locking groove of the hanger body. The locking ring initially embraces the smaller diameter portion of the mandrel and is thus in a recessed, inactive position. Releasable retaining means secures the catching ring to the mandrel until, when the combination of the mandrel and locking device has been inserted downwardly into the hanger body, the catching ring engages the catching groove of the hanger body so that the locking device can no longer move downwardly. Continued downward movement of the mandrel causes the locking ring, which is now restrained from moving with the mandrel because the locking ring engages the upper end of the catching ring, to be expanded into engagement with the locking groove of the hanger body by the action of the downwardly tapering actuating surface presented by the mandrel.

BRIEF DESCRIPTION OF THE DRAWINGS

In order that the manner in which the foregoing and other objects are achieved according to the invention can be understood in detail, one particularly advantageous embodiment of the invention will be described with reference to the accompanying drawings, which form part of the original disclosure in this application, and wherein.

DETAILED DESCRIPTION OF THE INVENTION

Figure 1:
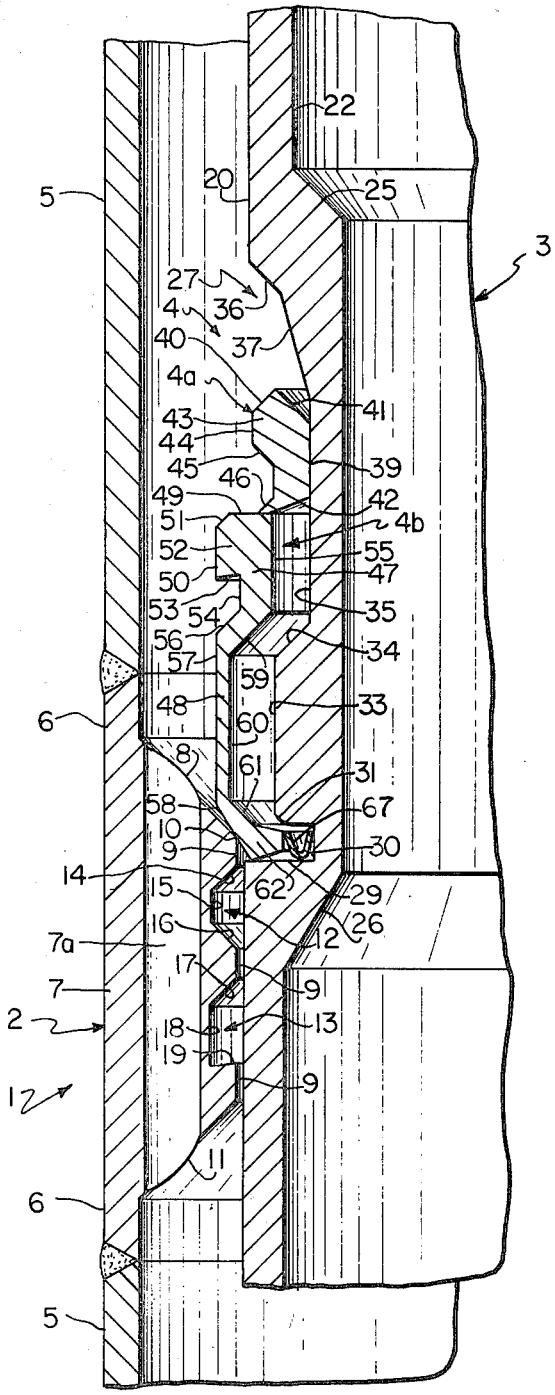
FIGS. 1–1B are fragmentary longitudinal cross-sectional views illustrating a hanger apparatus according to the invention, the figures being sequential, progressing from illustration of initial contact of the locking device with the hanger body, in FIG. 1, to illustration of the hanger completely landed and locked, in FIG. 1B.
Figure 1A:
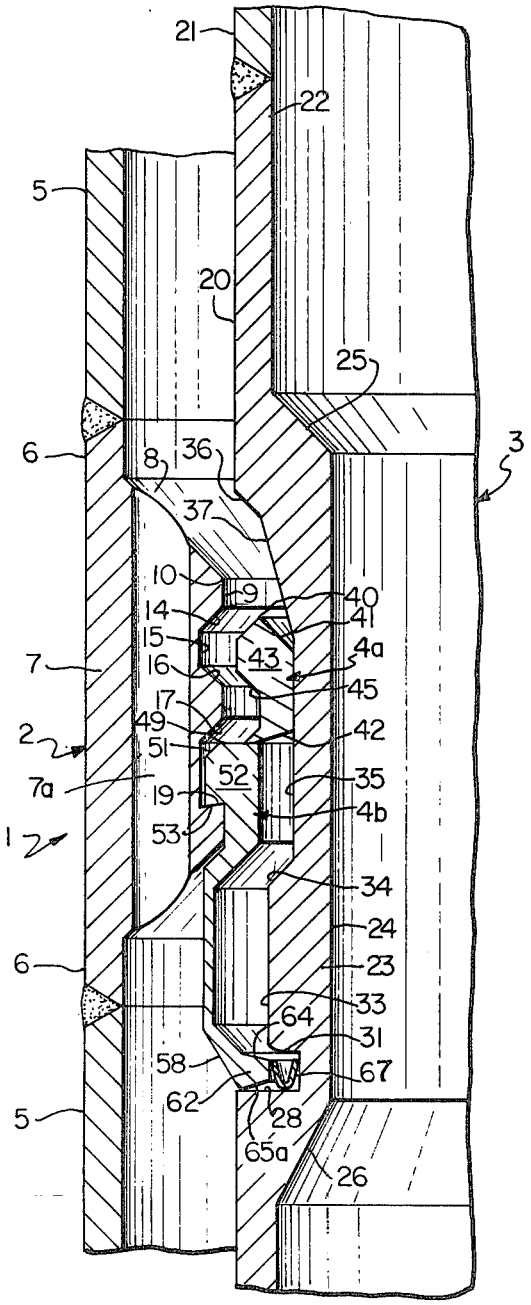
Figure 2:
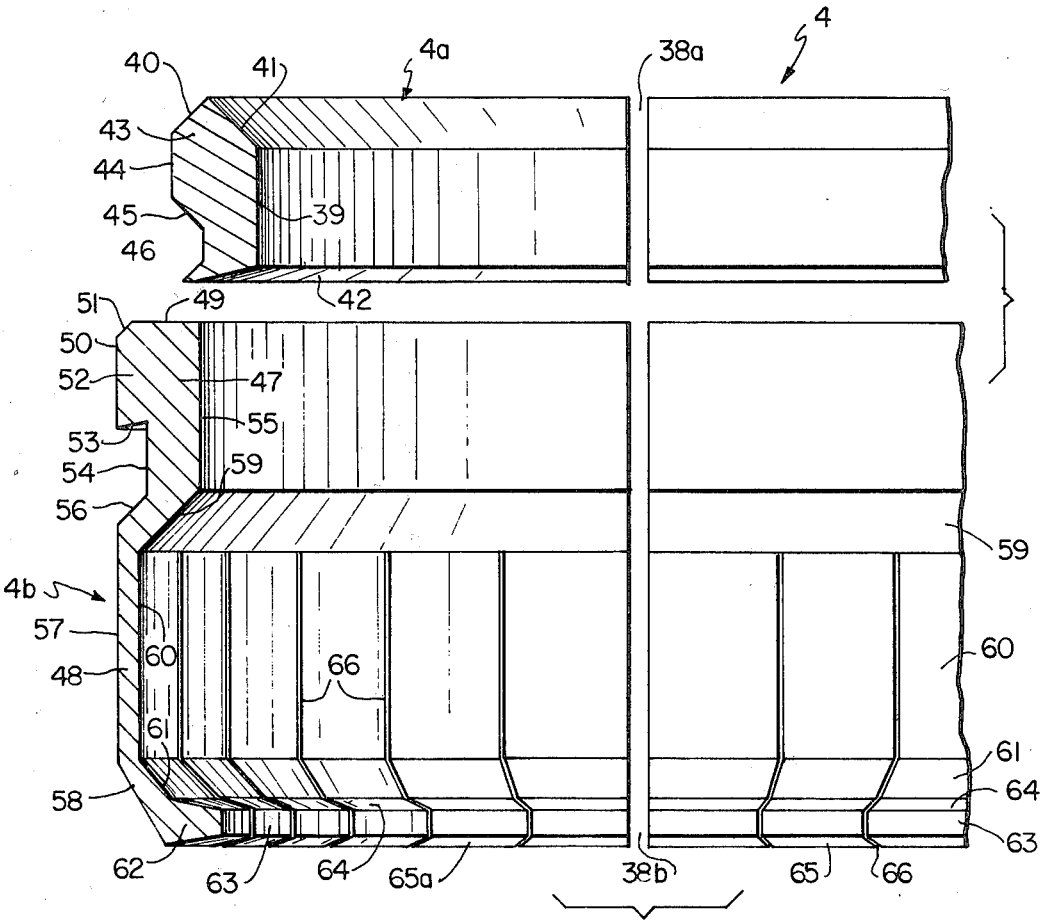
FIG. 2 is a view, partly in longitudinal cross section and partly in side elevation, of the locking device of the apparatus of FIG. 1.

Referring first to FIG. 1, the hanger apparatus 1 of this embodiment includes a hanger body 2, a hanger mandrel 3 and a resilient annular locking device indicated generally at 4 and shown in detail in FIG. 2. In this embodiment, hanger body 2 is carried by an outer pipe 5, such as a string of casing, and the hanger body is tubular, with an outer diameter equal to that of casing 5. End portions b of body 2 are right cylindrical and have the same wall thickness as the casing, each end portion being rigidly secured, as by welding, to the end of a different joint of the casing string. An intermediate portion 7 of body 2, which extends for most of the length of that body, is substantially thicker than end portions 6 and projects inwardly, being bounded at its upper end by a frusto-conical camming shoulder 8 which tapers downwardly and inwardly to join the right cylindrical inner surface 9 of portion 7 in an annular corner 10. The lower end of intermediate portion 7 is defined by an upwardly and inwardly tapering frusto-conical surface 11. A plurality of circularly spaced longitudinal through bores 7*a* are provided in portion 7 to allow fluid flow through body 2.

Inner surface 9 of portion 7 is interrupted by an upper transverse annular inwardly opening groove 12 and, spaced therebelow, a lower transverse annular inwardly opening groove 13. Upper groove 12 serves as a locking groove and is defined by a frusto-conical upper wall 14, which tapers upwardly and inwardly, a right cylindrical bottom wall 15, concentric with the longitudinal axis of pipe 5, and a frusto-conical load-bearing lower wall 16 which tapers downwardly and inwardly. Upper wall 14 constitutes a camming shoulder and lower wall 16 constitutes a load-bearing shoulder. Lower groove 13 serves as a catching groove and has a frusto-conical upwardly and inwardly tapering upper wall 17, a right cylindrical bottom wall 18, concentric with the longitudinal axis of pipe 5, and a lower frusto-conical wall 19 which tapers upwardly and inwardly at a small angle, advantageously about 5°. Wall 17 constitutes a camming shoulder and wall 19 constitutes a catching shoulder. Walls 14, 16 and 17 are advantageously each disposed at an angle of 45° relative to the pipe axis.

Hanger mandrel 3 is an integral body having a right cylindrical outer surface 20 equal in diameter to the outer surface of inner pipe 21 to be suspended, typically a casing string. End portions 22 of the mandrel are of the same wall thickness as the inner pipe and are rigidly secured thereto, as by welding. An intermediate portion 23 of mandrel 3 has a right cylindrical inner surface 24 which extends for a substantial portion of the length of the mandrel and is of significantly smaller diameter than that of the inner surface of the end portions 22, surface 24 being jointed to the inner surfaces of end portions 22 by frusto-conical shoulders 25 and 26. Portion 23 of the mandrel is provided with a stepped annular outwardly opening recess 27 which extends longitudinally for most of the length of intermediate portion 23 and is long as compared to portion 7 of hanger body 2. The lower end of recess 27 is defined by a transverse annular stop shoulder 28 which faces upwardly and lies in a plane at right angles to the longitudinal axis of the mandrel. Shoulder 28 also forms the lower wall of a transverse annular outwardly opening retaining groove 29. Groove 29 has a cylindrical bottom wall 30, concentric with the longitudinal axis of the mandrel, and a transverse annular upper wall 31 which is frusto-conical and tapers downwardly and inwardly at a small angle relative to shoulder 28.

Recess 27 is further defined by a larger diameter right cylindrical surface 33, which commences at the upper wall 31 of groove 29, an upwardly and inwardly tapering frusto-conical surface 34 at the upper end of surface 33, a smaller diameter right cylindrical surface 35, which commences at the upper end of surface 34, a frusto-conical downwardly and inwardly tapering load-bearing shoulder 36 defining the upper end of recess 27, and a frusto-conical intermediate surface 37 which tapers at a small angle relative to the axis of the mandrel downwardly and inwardly to connect the inner periphery of shoulder 36 and the upper end of surface 35. Surface 37 constitutes an actuating surface as hereinafter described. Shoulder 36 is at an angle of 45° to the pipe axis so as to be parallel to load-bearing shoulder 16 of groove 12 when the mandrel and hanger body are concentric.

Shown in detail in FIG. 2, locking device 4 comprises an integral resilient metal ring 4*a*, constituting the locking ring of the device, and a second integral resilient metal ring 4*b*, constituting the catching ring of the device. Both rings are split throughout their lengths as indicated at 38*a* and 38*b*.

Locking ring 4*a* has a right cylindrical inner surface 39, two upwardly converging frusto-conical end surfaces 40 and 41, and a bottom end surface 42. The locking ring includes a transverse annular outwardly projecting locking rib 43 which is defined by upper surface 40, a right cylindrical outer surface 44, and a downwardly and inwardly tapering frusto-conical surface 45. Surfaces 41 and 45 extend at 45° to the longitudinal axis of the ring and constitute parallel load-bearing shoulders. Surface 40 extends at 45° to the longitudinal axis of the ring and constitutes a camming shoulder to coact with upper wall 14 of groove 12. In a location spaced below shoulder 45, ring 4a has an upwardly and inwardly tapering frusto-conical surface 46 which also is disposed at 45° relative to the axis of the ring and which intersects end wall 42. Ring 4a is short in comparison to surface 35 and the diameter of surface 39, when ring 4a is relaxed and undistorted, is such that the ring will slidably embrace surface 35. Thus, the normal relaxed diameter of surface 39 is significantly smaller than the diameter of load-bearing shoulder 36.

Catching ring 4b comprises an upper main body portion 47 and a dependent skirt 48. Body portion 47 has a transverse annular flat upper end surface 49 lying in a plane at right angles to the axis of the ring, a right cylindrical outer surface portion 50, and, at the outer periphery of end surface 49, an upwardly and inwardly tapering frusto-conical surface 51. Body 47 presents the transverse annular outwardly projecting catching rib 52, defined by surfaces 49, 50 and 51 and, at the bottom of surface 50, a downwardly directed frusto-conical surface 53 which tapers upwardly and inwardly at a small angle, advantageously 5°, to constitute a catching shoulder to cooperate with shoulder 19 of hanger body 2. Body portion 47 further comprises a right cylindrical outer surface 54 which extends downwardly from the inner periphery of shoulder 53, and a right cylindrical inner surface 55. At catching rib 52, the radial thickness of body portion 47 is equal to that of ring 4a at locking rib 43.

Skirt 48 is markedly thinner, and therefore markedly more resilient, than is body portion 47. The outer surface of the skirt is defined by upwardly and inwardly tapering frusto-conical surfaces 56, a right cylindrical outer surface portion 57 of the same diameter as surface 50, and a downwardly and inwardly tapering frusto-conical surface portion 58 which constitutes a camming surface to cooperate with the upper end of intermediate portion 7 of hanger body 2. The inner surface of skirt 48 is defined by upwardly and inwardly tapering frusto-conical surface 59, which intersects surface 55, a right cylindrical main inner surface portion 60, and a downwardly and inwardly tapering frusto-conical surface portion 61. Formed integrally with the skirt at the bottom end thereof is a transverse annular inwardly directed retaining flange 62 defined by a right cylindrical inner wall 63, which is concentric with the longitudinal axis of the ring, and inwardly converging upper and lower frusto-conical side surfaces 64 and 65. To increase its resiliency, skirt 48 is provided with a plurality of circumferentially spaced, longitudinally extending slits 66 each extending from surface portion 59 throughout the length of the skirt and opening through flange 62.

Flange 62 is dimensioned to be accommodated by groove 29 of mandrel 3. Ring 4b is installed on mandrel 3 before the mandrel is welded or otherwise secured to two joints of the inner pipe, installation being accomplished by expanding the split ring and slipping the ring over one end of the mandrel, the moving the ring axially until flange 62 is aligned with groove 29, at which point the ring is allowed to relax so that the inner periphery of flange 58 is disposed just within the mouth of groove 29, as seen in FIG. 1. Advantageously, an annular radially resilient sheet metal spring 67, FIG. 1, of generally U-shaped radial cross section, is disposed within groove 29 with the U of the spring opening upwardly, to maintain ring 4b approximately centered on the mandrel. When ring 4b is in its initial position on the mandrel, the juncture between surfaces 58 and 65 engages shoulder 28, and the inner surface 63 of flange 62 is in a position such that, if the mandrel is moved downwardly relative to ring 4b, the corner presented by surfaces 63 and 64 will engage the frusto-conical upper wall 31 of groove 29. The length of cylindrical surface 33 of the mandrel is such that the portion of the mandrel defined by the upper wall of groove 29, surface 33 and surface 34 can be accommodated between flange 62 and surface 59 of the skirt of ring 4b.

Installation of outer pipe 5 positions hanger body 2 at that location from which the inner pipe 21 is to be suspended. As the inner pipe is run in, locking device 4 remains in the position on mandrel 3 seen in FIG. 1, being retained by engagement of flange 62 in groove 29 and the fact that locking ring 4a, slidably embracing surface 35, has its bottom wall 42 engaged with upper end face 49 of ring 4b. As the intermediate portion 23 of the mandrel enters hanger body 2, surface 58 of the skirt of ring 4b engages the corner 10 presented at the inner periphery of camming shoulder 8 of body 2. Further downward movement of the inner pipe causes ring 4b to be compressed inwardly. Initially, such compression is concentrated in skirt 48, occurring both because of the relatively thin wall of the skirt and because of the provisions of slits 66. As downward movement of the inner pipe continues, such compression progresses until all of outer surface 57 of the skirt has passed into the bore of the hanger body. Further downward movement of the mandrel brings the corner defined by shoulder 53 and surface 50 into engagement with camming shoulder 8, and the main body portion 47 of ring 4b is also compressed and enters the bore of the hanger body. Throughout such downward movement, flange 62 remains engaged in groove 29 so that ring 4b is positively retained in its initial axial position relative to mandrel 3.

Figure 1B:
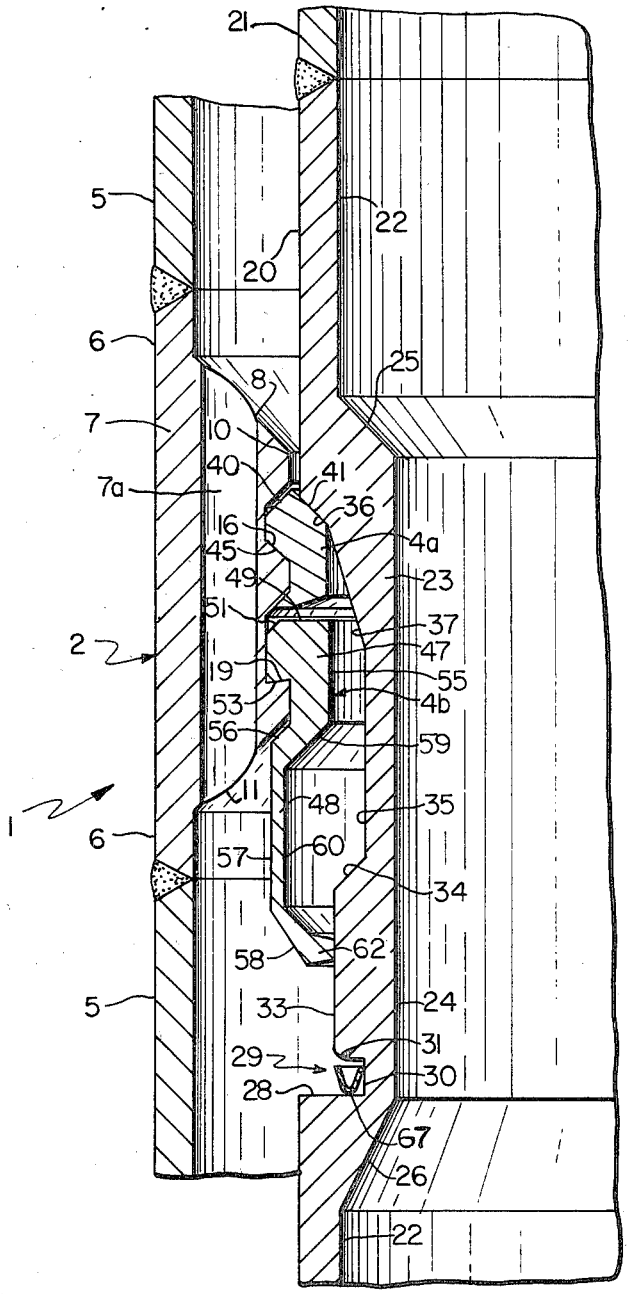

Continued downward movement of the combination of mandrel 3 and locking device 4 causes catching rib 52 to pass groove 12, and catching rib 52 passes downwardly to the location of catching groove 13. As rib 52 begins to mate with groove 13, catching shoulder 53 begins to overlap with catching shoulder 19 of the hanger body so that, as downward movement continues, shoulder 53 engages shoulder 19 and the taper of these two shoulders causes the two shoulders to coact to force ring 4 outwardly until, as seen in FIG. 1B, the catching rib is well engaged with the catching groove. Throughout such downward movement of the mandrel, locking ring 4a remains in place on surface 35 and in engagement with upper end face 49 of ring 4b.

Engagement of shoulder 53 with shoulder 19 stops ring 4b against further downward movement. At this stage, since rib 52 is mated with groove 13, ring 4b is free to relax fully. Continued downward movement of the mandrel forces upper wall 31 of groove 29 downwardly against upper surface 64 of flange 62 and causes flange 62 to ride out of groove 29 and to slidably embrace surface 33 of the mandrel, so that the mandrel is now free to move downwardly through rings 4a and 4b. Disengagement of flange 62 from groove 29 causes skirt to be resiliently distorted outwardly, tending further to assure proper mating of catching rib 52 in groove 13.

Downward movement of mandrel 3 now causes actuating surface 37 to enter locking ring 4a. Since the locking ring is held stationary, as to axial movement, because of its engagement with upper end face 49 of ring 4b, surface 37 acts to expand the locking ring progressively, with the juncture between surfaces 42 and 46 sliding outwardly along surface 49. Such expansion of ring 4a continues until rib 43 is fully engaged in locking groove 12 of hanger 2. Such engagement causes shoulder 45 of ring 4a to engage shoulder 16 of groove 12, with the result that shoulder 45 moves along shoulder 16 and rib 43 is fully inserted in groove 12. Ring 4a is thus elevated above ring 4b, so that downwardly acting loads are not transmitted from ring 4a to ring 4b. Finally, continued downward movement of the mandrel causes mandrel shoulder 36 to come into flush engagement with shoulder 41 of ring 4a, completing the locking action. At this stage, all downwardly acting loads applied by the mandrel act in a straight line at right angles to engaged shoulders 36, 41, 45 and 16, so that the full load is transmitted through ring 4a to hanger body 2.

When it is desired to recover the inner pipe string, applying an upward strain on that pipe string causes stop shoulder 28 of the mandrel to come into engagement with the lower end of ring 4b, flange 62 then again being free to enter groove 29. Accordingly, as the mandrel is moved upwardly with the pipe string, ring 4b is moved upwardly with the mandrel until surface 51 engages surface 17 and surface 56 engages surface 11. Ring 4b is therefore cammed inwardly until rib 52 disengages from groove 13. During initial upward movement of mandrel 3 and ring 4b, locking ring 4a remains generally in place. End face 49 of ring 4b then comes into engagement with the lower end face 42 of ring 4a, and ring 4a is forced to travel upwardly with the mandrel and ring 4b. As a result, camming surface 40 of ring 4a is forced against shoulder 14 of groove 12 and upward movement of the combination of rings 4a and 4b is resisted, movement of the mandrel continuing. As actuating surface 37 moves upwardly through ring 4a, ring 4a contracts to its normal, relaxed position, directly embracing cylindrical surface 35 of the mandrel. Rib 52 moves past groove 12 but ineffectually, shoulder 51 engaging shoulder 14 to cam ring 4b inwardly so that the ring moves upwardly and out of hanger body 2. Thus, the parts will have returned to the position illustrated in FIG. 1.

While catching shoulders 19 and 53 advantageously taper at an angle of about 5° relative to planes at right angles to the longitudinal pipe axis, the angle of taper of these shoulders can be 2°–10°, smaller angles having a reduced tendency to urge the catching ring 4b outwardly under downward loads, and larger angles having an increased danger of damage to the corners at the peripheries of the shoulders. While shoulders 36, 41, 45 and 16 are advantageously at 45°, the angle of taper of these shoulders can be 30°–60°, so long as all four shoulders are essentially parallel to each other.

What is claimed is:

1. In a hanger apparatus for suspending an upright inner pipe from an outer pipe or other annular outer member, the combination of a tubular hanger body to be carried by the outer member, said hanger body comprising an upwardly directed transverse annular camming shoulder, a transverse annular inwardly opening locking groove spaced below said camming shoulder, and a transverse annular inwardly opening catching groove spaced below said locking groove;

a tubular hanger mandrel to be carried by the inner pipe, said mandrel having an axialy elongated transverse annular outwardly opening recess, a transverse annular upwardly directed stop shoulder at the lower end of said recess, a transverse annular downwardly directed load-bearing shoulder at the upper end of said recess, an annular outer surface portion of smaller diameter than said load-bearing shoulder and located below said load-bearing shoulder, and an annular downwardly and inwardly tapering actuating surface between said load-bearing shoulder and said smaller diameter portion; and an annular locking device carried by said mandrel, said locking device being disposed in said recess and comprising annular resiliently contractable and expandable locking means including an outwardly projecting transverse annular locking rib and having a normal condition, when the locking means is relaxed and undistorted, such that the inner periphery of the locking means is smaller than said actuating surface, said locking means being initially disposed in a position surrounding said smaller diameter outer surface portion, annular resiliently contractable and expandable catching means surrounding the mandrel, said catching means comprising a transverse annular outwardly projecting catching rib and a downwardly and inwardly tapering downwardly facing camming surface located below said catching rib, and releasable retaining means releasably securing said catching means to the mandrel in a location between said locking means and said upwardly directed stop shoulder, the diameter of said catching means, when said catching means is retained by said retaining means, being such that the outer diameter of said downwardly facing camming surface is larger than the inner diameter of said upwardly facing camming shoulder of the hanger body and the inner diameter of the catching means is larger than the outer diameter of the portion of the mandrel surrounded by the catching means;

lowering of the combination of the mandrel and locking device into the hanger body first causing said camming surface to engage said camming shoulder and compress said catching means to allow the same to enter the hanger body;

continued downward movement of the combination of the mandrel and locking device then causing the catching rib to engage in said catching groove and hold the catching means against further downward movement relative to the hanger body, whereby continued downward movement of the mandrel causes said retaining means to release the catching means;

further downward movement of the mandrel then causing said actuating surface to enter said locking means and, with the locking means restrained axially by engagement with the upper end of said catching means, cause said locking means to expand into locking engagement between a surface of said locking groove and said load-bearing shoulder of the mandrel.

2. The combination defined in claim 1, wherein said locking means is an integral split ring.

3. The combination defined in claim 2, wherein said smaller diameter outer surface portion is right cylindrical and said locking means slidably embraces said smaller diameter outer surface portion when the locking means is in its initial position.

4. The combination defined in claim 1, wherein the outer diameter of said locking means is not substantially greater than the outer diameter of said load-bearing shoulder when the locking means is in its initial position.

5. The combination defined in claim 1, wherein said catching means is an integral split ring having a body portion which is relatively thick and carries said catching rib.

6. The combination defined in claim 5, wherein said catching groove has a lower transverse annular wall constituting a catching shoulder and an upper transverse annular frusto-conical wall which tapers upwardly and inwardly and constitutes a camming surface; and said body portion of the catching means has a transverse annular upper end face adapted to engage the lower end of said locking means and, at the outer periphery of said upper end face, a frusto-conical upwardly and inwardly tapering camming surface disposed to cooperate with said upper wall of the catching groove when, after said catching rib has been engaged with said catching groove, the mandrel is moved upwardly relative to the hanger body and said upwardly directed stop shoulder engages the lower end of said catching means to move the catching means upwardly relative to the hanger body.

7. The combination defined in claim 6, wherein said frusto-conical upper wall of the catching groove is axially longer than said camming surface of the body portion of the catching means; and said locking means includes an outer frusto-conical surface which tapers upwardly and inwardly and is located below said locking rib in a position to extend below the upper wall of the catching groove when the locking rib is engaged in the locking groove.

* * * * *